US008025553B2

(12) United States Patent
Sekiya et al.

(10) Patent No.: US 8,025,553 B2
(45) Date of Patent: Sep. 27, 2011

(54) BACK GRINDING METHOD FOR WAFER

(75) Inventors: Kazuma Sekiya, Ota-Ku (JP); Yusuke Kimura, Ota-ku (JP); Takashi Mori, Ota-ku (JP); Toshiharu Daii, Ota-Ku (JP)

(73) Assignee: Disco Corporation, Tokyo (JP)

( * ) Notice: Subject to any disclaimer, the term of this patent is extended or adjusted under 35 U.S.C. 154(b) by 740 days.

(21) Appl. No.: 12/175,197

(22) Filed: Jul. 17, 2008

(65) Prior Publication Data

US 2009/0042488 A1 Feb. 12, 2009

(30) Foreign Application Priority Data

Aug. 8, 2007 (JP) ..... 2007-207168

(51) Int. Cl.
*B24B 1/00* (2006.01)

(52) U.S. Cl. ..... 451/5; 451/41; 451/54; 451/63

(58) Field of Classification Search ..... 451/5, 41, 451/56, 63

See application file for complete search history.

(56) References Cited

FOREIGN PATENT DOCUMENTS

JP A 2005-57052 3/2005

*Primary Examiner* — Maurina Rachuba

(74) *Attorney, Agent, or Firm* — Greer, Burns & Crain, Ltd.

(57) ABSTRACT

A back grinding method for a wafer includes covering a face-side surface of the wafer with a resin film, and cutting the surface of the resin film to form a flat surface parallel to the face-side surface of the wafer. The wafer is held with the surface of the resin film in contact with a suction surface of a chuck table in a grinding apparatus, and the exposed back-side surface of the wafer is ground. Unevenness in thickness of the resin film is suppressed, whereby the thickness of the wafer subjected to back grinding is made to be uniform.

3 Claims, 10 Drawing Sheets

BACK GRINDING METHOD FOR WAFER

BACKGROUND OF THE INVENTION

1. Field of the Invention

The present invention relates to a method of grinding a back-side surface of a wafer such as a semiconductor wafer so as to thin the wafer.

2. Description of the Related Art

In a semiconductor device manufacturing process in which a face-side surface of a wafer composed of a semiconductor such as silicon is provided with a multiplicity of devices and the wafer is divided to obtain the devices as individual chips, a step of grinding the back-side surface of the wafer so as to thin the wafer is conducted at the stage of wafer. The thinning of the wafer corresponds to thinning of device packages, and the wafer is thinned, for example, from an initial thickness of around 700 μm to about 200 μm. In accordance with the marked thinning nowadays, the wafers may in some cases be thinned to a very small thickness of 50 μm or 30 μm.

For grinding the back-side surface of a wafer, infeed grinding is generally used in which the wafer is suction held onto a vacuum chuck type chuck table, and, while revolving the wafer about its center by rotating the chuck table, a grinding tool such as a grindstone is pressed against the back-side surface of the wafer. In the case of grinding the back-side surface of a wafer in this manner, the face-side surface of the wafer is covered with a protective member so that the face-side surface does not make direct contact with the holding surface of the chuck table, in order to prevent electronic circuits of the devices from being damaged (refer to Japanese Patent Laid-open No. 2005-057052).

Examples of the protective member include a protective tape obtained by applying an acrylic pressure sensitive adhesive material to one side of a base sheet made of polyolefin or the like. In such a protective tape, in many cases, at least one of the base sheet and the pressure sensitive adhesive material has unevenness, if slight, in the thickness thereof. If such a protective tape is adhered to the face-side surface of the wafer and the back-side surface of the wafer is ground, the unevenness of thickness of the protective tape would be transferred to the wafer, resulting in unevenness of thickness of the wafer as a single body. If the finished thickness of the wafer is comparatively large and the unevenness of thickness of the protective tape is as tiny as about 3 μm, for example, the ratio of the thickness unevenness to the wafer thickness after grinding is so small as not to matter considerably. If the finished thickness of the wafer is as extremely small as about 30 μm, however, the thickness unevenness of 3 μm is as large as 10% of the wafer thickness and, therefore, it is difficult to make uniform the wafer thickness with high precision.

The above-mentioned patent document discloses a protective film formed by applying a fluid resist to the back-side surface of a wafer by a spin coating process or a printing process. However, even such a protective film has unevenness of thickness, so that the protective film is not superior to the protective tape from the viewpoint of thickness unevenness.

SUMMARY OF THE INVENTION

Accordingly, it is an object of the present invention to provide a method of grinding a back-side surface of a wafer by which the unevenness of thickness of a wafer as a single body due to the thickness unevenness of a protective member in the prior art can be suppressed and a wafer with a uniform thickness can be obtained in high precision.

In accordance with an aspect of the present invention, there is provided a method of grinding a back-side surface of a wafer having a face-side surface provided with devices, the method including: a resin film covering step of covering the face-side surface of the wafer with a resin film; and a wafer holding step of holding the wafer, with the face-side surface exposed, by a holding means of a cutting apparatus of which the facing angle relative to a machining plane of a cutting member held by a rotating body can be controlled to be substantially parallel. The method further includes: a wafer angle controlling step of regulating the facing angle of the holding means relative to the cutting member so as to control the face-side surface of the wafer held by the holding means to be substantially parallel to the machining plane of the cutting member; a resin film cutting step of cutting a surface of the resin film to be flat by the cutting member being rotated; and a back-side grinding step of holding the wafer by a holding means of a grinding apparatus with the cut surface of the resin film being directed downward and grinding the exposed back-side surface of the wafer.

The resin film covering the face-side surface of the wafer is provided by applying a liquid resin to the face-side surface of the wafer by a spin coating process, or by adhering a pressure sensitive adhesive tape to the face-side surface of the wafer.

In the present invention, in the wafer angle controlling step the face-side surface of the wafer held by the holding means of the cutting apparatus is controlled to be substantially parallel to the machining plane of the cutting member, whereby it is ensured that when the surface of the resin film is cut in the subsequent resin film cutting step, the cut surface becomes a flat surface parallel to the face-side surface of the wafer. When the resin film has unevenness of thickness, the thickness unevenness is suppressed by cutting the surface of the resin film. When the wafer is held by the holding means of the grinding apparatus with the cut surface of the resin film being directed downward and the back-side surface of the wafer which is exposed in this condition is ground, the ground back-side surface is processed to be a flat surface parallel to the face-side surface of the wafer. In other words, the wafer subjected to back grinding becomes uniform in thickness.

In the back grinding step, the resin film is kept by the holding means of the grinding apparatus, and the face-side surface of the wafer does not make direct contact with the holding surface of the holding means, so that the devices are protected.

According to the present invention, instead of using the protective film in the related art which is accompanied by unevenness of thickness, the face-side surface of the wafer is covered with the resin film, the surface of the resin film is cut to form a reference surface parallel to the face-side surface of the wafer, and the surface of the resin film is kept by the holding means of the grinding apparatus, which ensures that the wafer as a single body after the back grinding is uniform in thickness. The resin film after the cutting is a protective member free of thickness unevenness, and its surface serves as an appropriate reference surface in back grinding. Therefore, with the resin film provided on the face-side surface of the wafer, the thickness unevenness of the wafer after the back grinding can be suppressed.

According to the present invention, the surface of the resin film covering the face-side surface of the wafer is cut to be a flat surface parallel to the face-side surface of the wafer, the surface of the resin film is kept by the holding means of the grinding apparatus, and, in this condition, the back-side surface of the wafer is ground. Therefore, the thickness unevenness of the wafer as a single body due to the thickness unevenness of the protective member in the related art can be suppressed, resulting in that a wafer with a uniform thickness can be obtained in high precision.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1A:
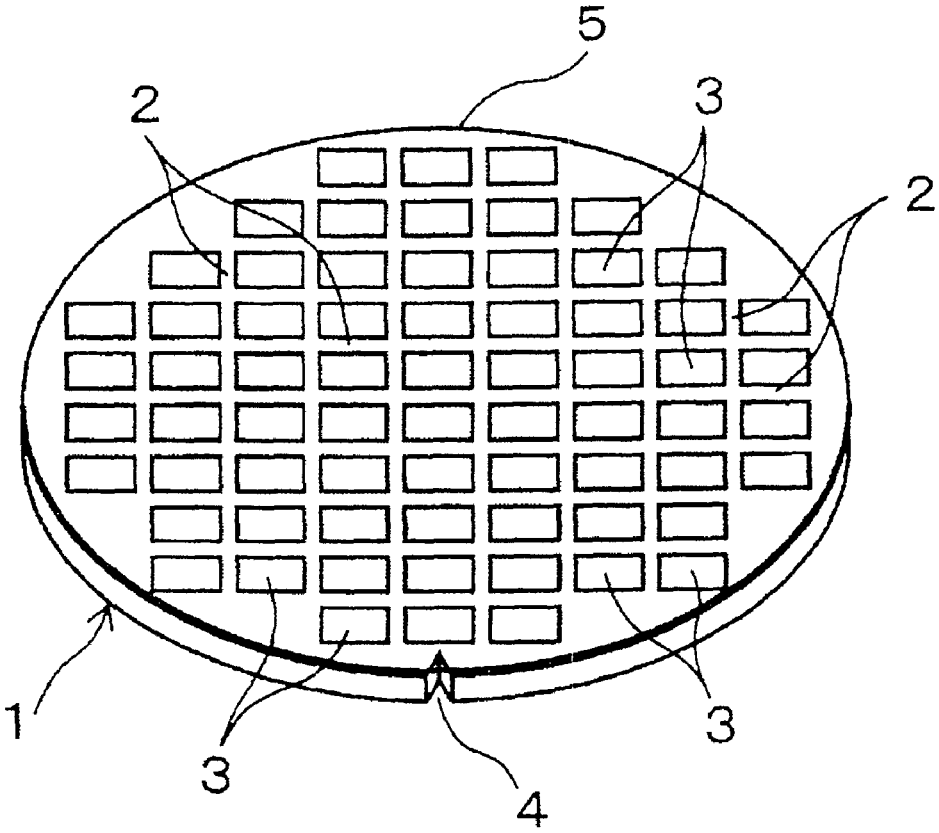
FIG. 1A is a perspective view of a semiconductor wafer subjected to back grinding by a method according to an embodiment of the present invention.

Now, a method of grinding a back-side surface of a wafer according to an embodiment of the present invention will be described below referring to the drawings. Symbol 1 in FIG. 1 denotes a circular disk-shaped semiconductor wafer (hereinafter referred to as the wafer) to be thinned by back grinding. The wafer 1 is a silicon wafer or the like, and the thickness thereof before machined is, for example, about 700 μm and uniform. A face-side surface 1*a* of the wafer 1 is demarcated by grid-like planned dividing lines 2 into a plurality of rectangular semiconductor chips (devices) 3. At the surfaces of the semiconductor chips 3, electronic circuits not shown such as ICs and LSIs are formed. In addition, a peripheral surface of the wafer 1 is provided at a predetermined position with a V-shaped notch 4 which indicates the crystal orientation of the semiconductor.

Figure 2A:
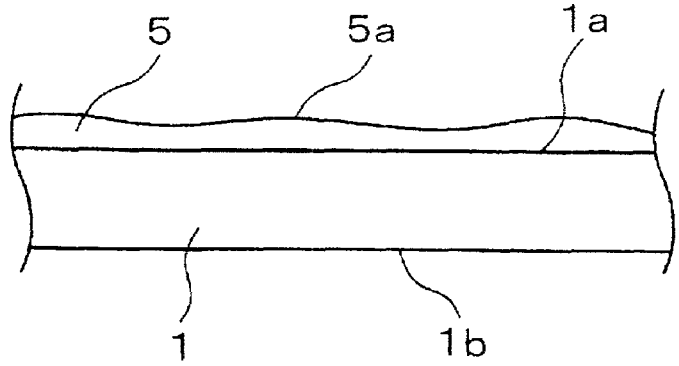
FIGS. 2A to 2C are side views illustrating the gist of the method according to the embodiment.
Figure 2B:
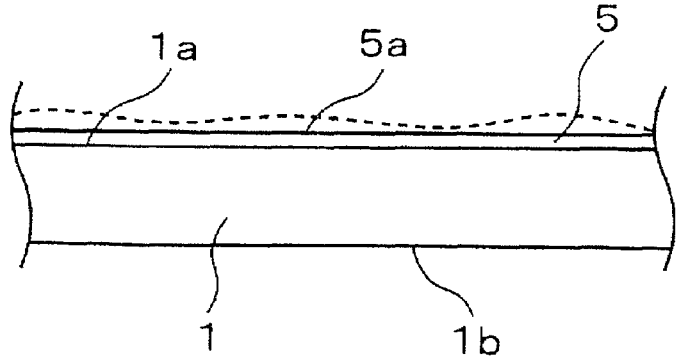
Figure 2C:
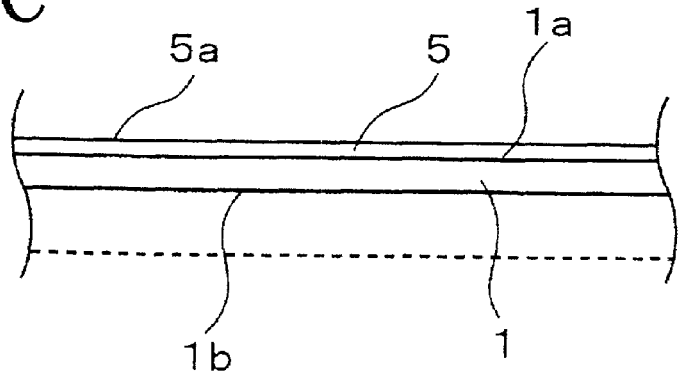

The method of grinding a back-side surface of a wafer according to this embodiment includes, as shown in FIGS. 2A to 2C, covering the face-side surface 1*a* of the wafer 1 with a resin film 5, then cutting the surface 5*a* of the resin film 5 to make the surface 5*a* parallel to the face-side surface 1*a* of the wafer 1, and thereafter grinding a back-side surface 1*b* of the wafer 1 so as to thin the wafer 1 to a desired thickness (for example, 30 to 50 μm). Now, this process will be described in detail below.

Figure 1B:
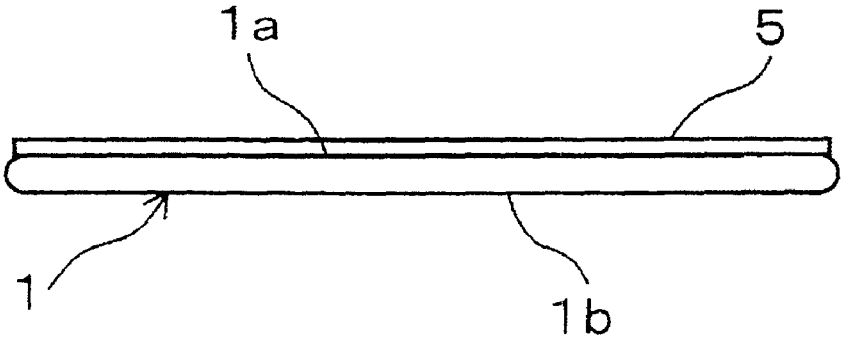
FIG. 1B is a side view of the same.

As above-mentioned, in this embodiment, first, the face-side surface 1*a* of the wafer 1 is covered with the resin film 5 having a thickness (for example, 5 to 100 μm or more) according to the rugged (projection-and-recess) state of the face-side surface 1*a* (resin film covering step). The resin film 5 is formed, for example, by using a photo-resist (a film of a photosensitive resin) known in the photolithography technique. For covering the face-side surface 1*a* of the wafer 1 with the resist, a spin coating process is preferably adopted in which the wafer 1 is mounted and held on a table driven to rotate in such a manner that the face-side surface 1*a* is exposed and the center of the wafer 1 is located on the rotational axis of the table, the table 1 is rotated, and the resist in a liquid state is dropped onto the center of the wafer 1 being rotated so that the resist is distributed under the centrifugal force to the whole area of the face-side surface 1*a*. The resin film 5 thus formed is shown on the face-side surface 1*a* of the wafer 1 in FIGS. 1A and 1B. In FIG. 1A, semiconductor chips 3 covered with the resin film 5 are shown in the seen-through state.

Figure 3:
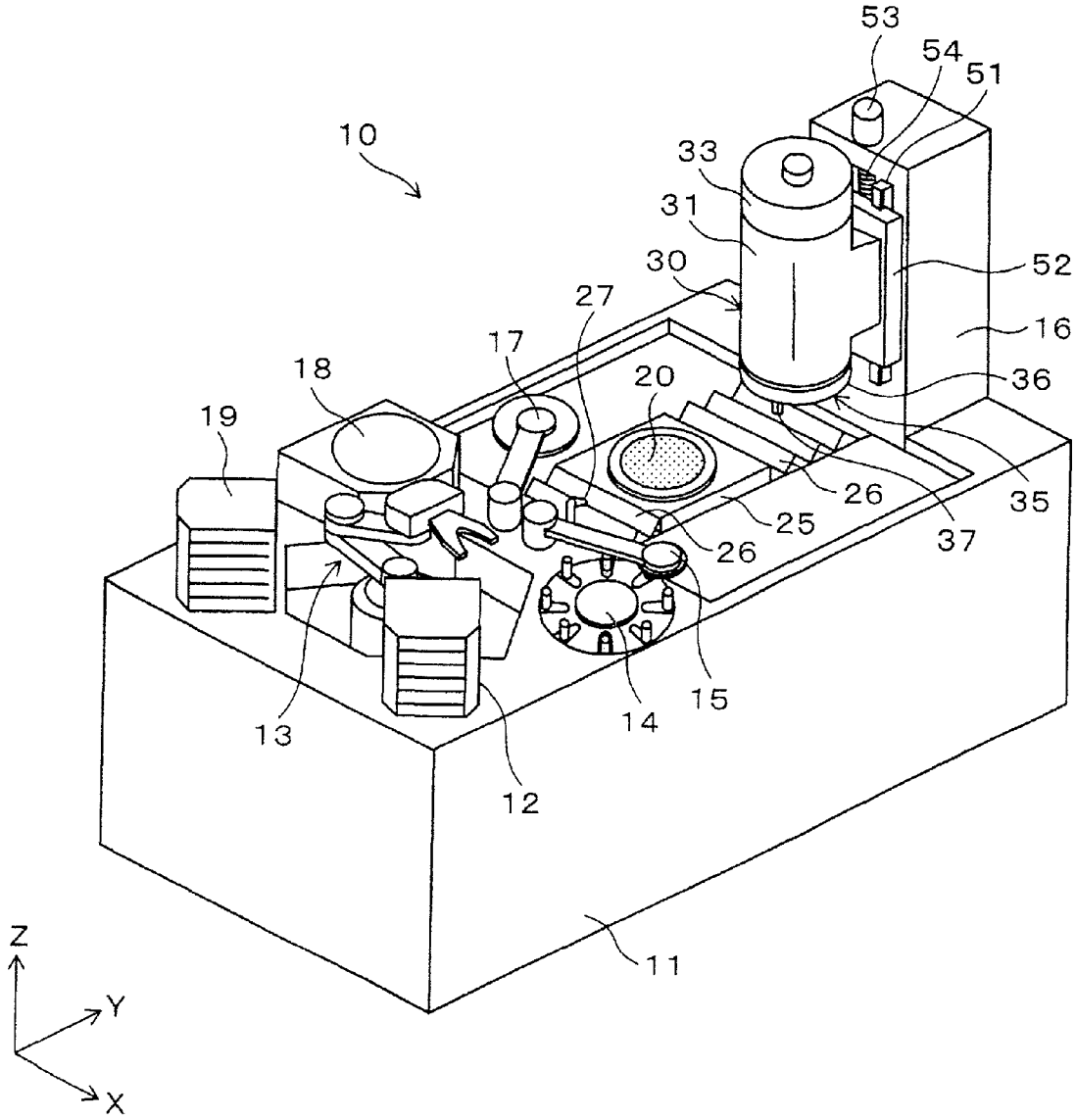
FIG. 3 is a general perspective view of a cutting apparatus used in the method according to the embodiment.
Figure 4:
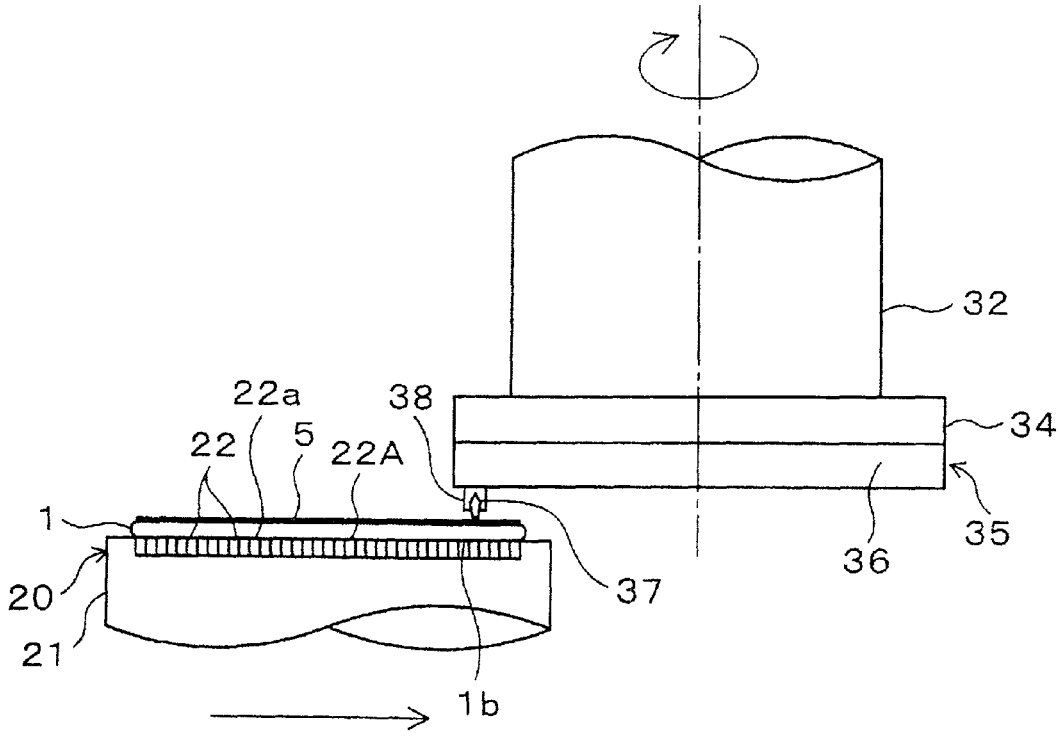
FIG. 4 is a side view showing a cutting unit and a chuck table of the cutting apparatus shown in FIG. 3.

The wafer 1 having its face-side surface 1*a* covered with the resin film 5 is then subjected to a process in which the surface 5*a* of the resin film 5 is cut to be flat. For the cutting, a cutting apparatus 10 shown in FIG. 3 is used. According to the cutting apparatus 10, the back-side surface 1*b* of the wafer 1 is suction held onto a suction surface of a vacuum chuck type chuck table 20, and the surface 5*a* of the resin film 5 is cut to be flat by a cutting tool 37 of a cutting implement 35 being rotated of a cutting unit 30. As will be described later also, the cutting implement 35 has a structure in which the cutting tool 37 is detachably attached to a lower surface of an annular frame 36, as shown in FIG. 4.

Now, the configuration and operations of the cutting apparatus 10 will be described below. The cutting apparatus 10 has a rectangular parallelopiped base 11, and a plurality of the wafers 1 are stackedly contained in a supply cassette 12 detachably set at a predetermined position on the base 11 so that the face-side surface 1*a* covered with the resin film 5 of each of the wafers 1 is on the upper side. One of the wafers 1 is drawn out of the supply cassette 12 by a feeding robot 13, and the wafer 1 is put on a positioning table 14 with its face-side surface 1*a* up, where it is positioned into a predetermined position.

The wafer 1 thus positioned on the positioning table 14 is picked up from the positioning table 14 by a supply arm 15, and is concentrically put on a circular disk-shaped chuck table 20 being in vacuum operation, with its face-side surface 1*a* up (wafer holding step). As shown in FIG. 4, the chuck table 20 is of a pin chuck structure in which a suction part 22A having a multiplicity of pins 22 in erect state is formed at a central upper part of a frame body 21, and the wafer 1 is suction held in such a condition that its back-side surface 1*b* is in contact with a suction surface 22*a* as an upper surface of the suction part 22A and that the resin film 5 on the side of its face-side surface 1*a* is exposed.

As shown in FIG. 3, the chuck table 20 is non-rotatably supported on a table base 25 provided to be movable in a Y direction on the base 11. The wafer 1 is fed from a loading/unloading position on the viewer's side in the Y direction, where it is put on the chuck table 20, into a machining position on the depth side in the Y direction, through the table base 25 and the chuck table 20. On the upper side of the machining position, the cutting unit 30 is disposed which is operative to cut the surface 5*a* of the resin film 5 formed on the face-side surface 1*a* of the wafer 1. On the base 11, a bellows-like cover 26 for closing a moving path of the table base 25 so as to prevent cuttings or the like from dropping into the base 11 is provided so that it can be contracted and expanded.

In the cutting unit 30, the cutting tool 37 for actually cutting the resin film 5 is rotated in a horizontal plane, so that the cutting or machining plane formed by the rotational locus of a cutting part at the tip of the cutting tool 37 is also horizontal. The chuck table 20 is so configured that the frame body 21 is swingably supported on the table base 25, whereby the facing angle of the suction surface 22*a* relative to the cutting or machining plane of the cutting tool 37 can be controlled in the following manner.

Figure 5A:
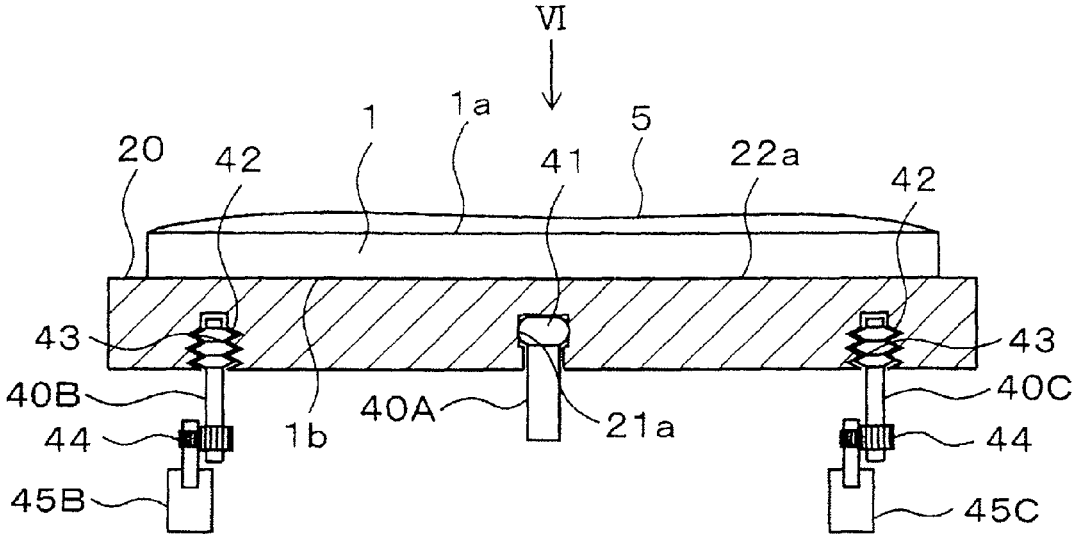
FIGS. 5A and 5B are side views showing the support structure and operation of the chuck table of the cutting apparatus shown in FIG. 3.
Figure 5B:
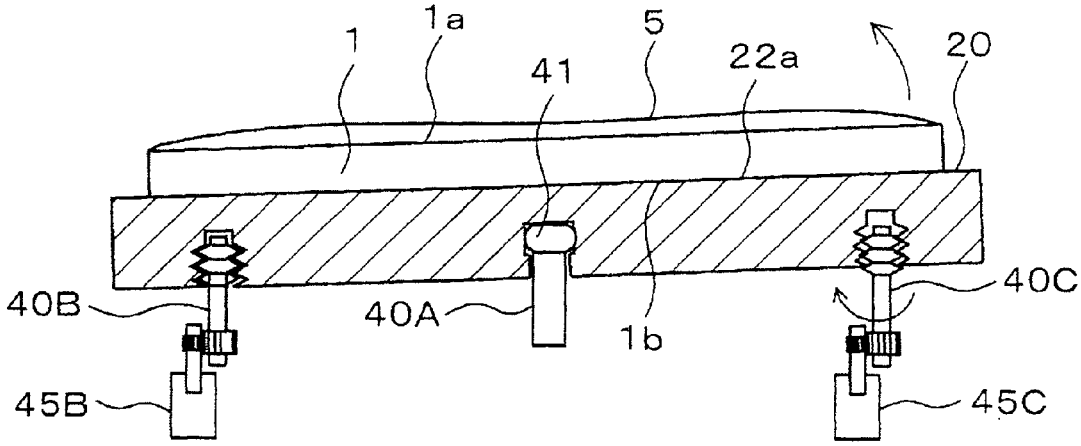
Figure 6:
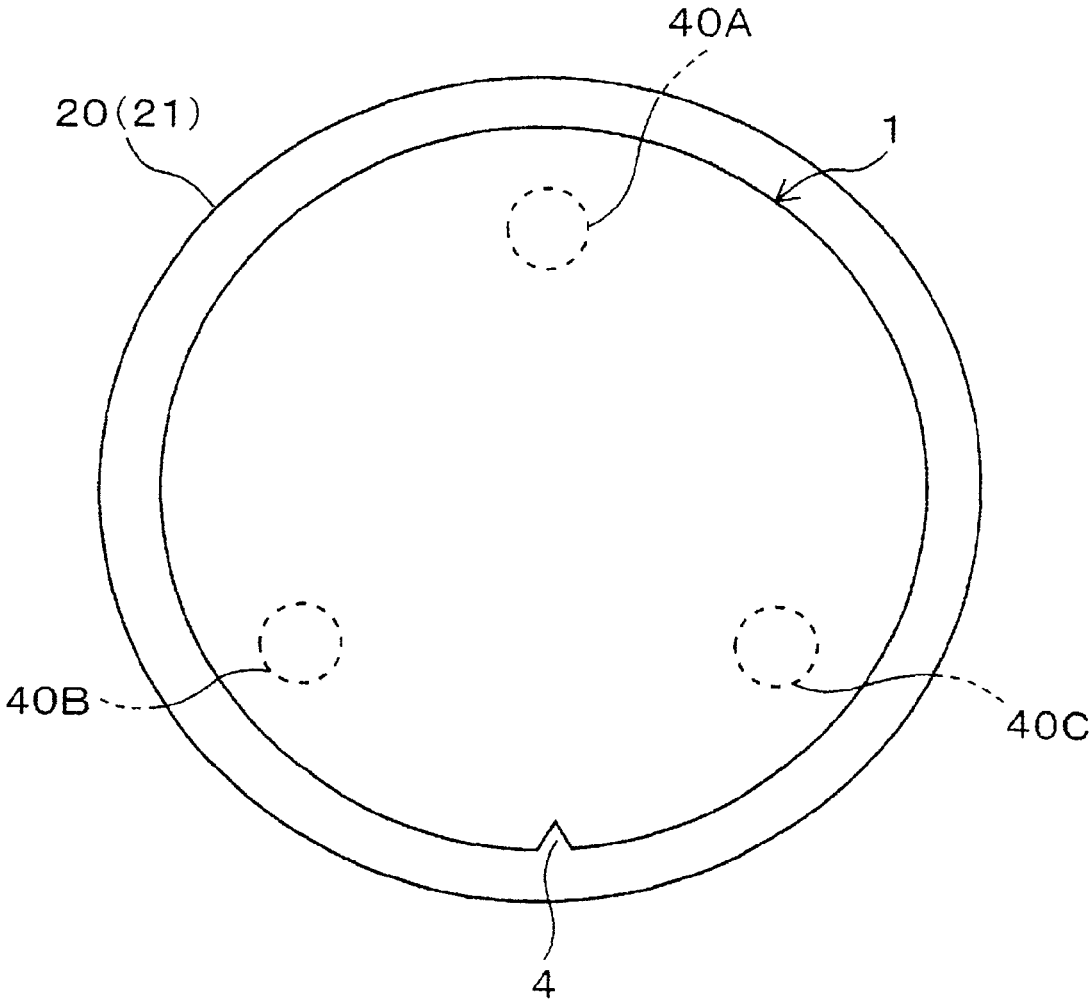
FIG. 6 is a view taken along arrow VI of FIG. 5A.

As shown in FIGS. 5A, 5B and 6, the frame body 21 of the chuck table 15 is supported by one fixed shaft 40A and two movable shafts, i.e., a first movable shaft 40B and a second movable shaft 40C, which are incorporated in the table base 25. The shafts 40A to 40C have their axial directions in a Z direction, and are disposed respectively at the three vertexes of a regular triangle having its center at the center of rotation of the chuck table 20.

As shown in FIG. 5A, a pivot 41 formed at the upper end of the fixed shaft 40A is fitted in a bearing hole 21*a* formed in a lower surface side part of the frame body 21 of the chuck table 20, and the chuck table 20 is swung, with the pivot 41 as a fulcrum. The first and second movable shafts 40B and 40C are attached to the table base 25 so that they can be rotated and their movements in the axial direction are restricted. Screw parts 42 formed at the upper ends of the movable shafts 40B and 40C are screw engaged in screw holes 43 formed in lower surface side parts of the frame body 21, and the movable shafts 40B and 40C are rotated by motors 45B and 45C through speed reduction gear trains 44 provided at lower end parts thereof, respectively.

With the first movable shaft 40B and the second movable shaft 40C rotated, the movable shaft attaching parts of the frame body 21 are lifted up or down according to the directions of rotation, whereby the chuck table 20 as a whole is swung, with the pivot 41 of the fixed shaft 40A as a fulcrum. In the chuck table 20, the state with the suction surface 22*a* kept horizontal is a fundamental posture, and the chuck table 20 is swung by appropriately operating the two movable shafts 45B and 45C, whereby the facing angle of the suction surface 22*a* relative to the cutting unit 20 can be varied. FIG. 5A shows the condition where the suction surface 22*a* of the chuck table 20 is horizontal; on the other hand, FIG. 5B shows the condition where the chuck table 20 is inclined by rotating the second movable shaft 40C in a direction for coming out of the screw hole 43 so as to raise that part of the chuck table 20.

The cutting unit 30 is disposed at a front surface of a column 16 erecting at an end part on the depth side of the base 11 so that it can be lifted up and down along the Z direction (vertical direction). More specifically, a guide 51 extending in the Z direction is provided on the front surface of the column 16, and the cutting unit 30 is slidably mounted to the guide 51 through a slider 52. The cutting unit 30 is lifted up and down in the Z direction through the slider 52, by a ball screw type feeding mechanism 54 driven by a servo motor 53.

The cutting unit 30 has a structure in which a spindle shaft 32 shown in FIG. 4 is coaxially and rotatably supported in a cylindrical spindle housing 31 of which the axial direction is in the Z direction. The spindle shaft 32 is driven to rotate by a spindle motor 33 fixed at an upper end part of the spindle housing 31. As shown in FIG. 4, the cutting implement 35 is attached to the lower end of the spindle shaft 32 through a circular disk-shaped flange 34.

The cutting implement 35 has the cutting tool 37 detachably attached to the lower surface of the annular frame 36 through a shank 38, and the frame 36 is so designed to be coaxially attached to the flange 34. The cutting tool 37 is provided at its lower end with the cutting part which is formed of diamond or the like and operative to actually cut a work. The cutting implement 35 is rotated as one body with the spindle shaft 32, and the outer diameter of cutting of the cutting tool 37 is set to be greater than the diameter of the wafer 1. The cutting or machining plane formed by the rotational locus of the cutting part at the tip of the cutting tool 37 is set to be horizontal, as above-mentioned.

In cutting the resin film 5 by the cutting unit 30, in the loading/unloading position the suction surface 22*a* of the chuck table 20 is controlled to be horizontal, and the facing angle of the suction surface 22*a* relative to the cutting or machining plane of the cutting tool 37 is set to be parallel (wafer angle controlling step). Since the wafer 1 is uniform in thickness, the result of controlling the suction surface 22*a* to be horizontal is that the face-side surface 1*a* (the surface covered with the resin film 5) of the wafer 1 held on the suction surface 22*a* is set to be parallel to the cutting or machining plane of the cutting tool 37, i.e., set to be horizontal. In this embodiment, the step of thus setting the face-side surface 1*a* of the wafer 1 in parallel to the cutting or machining plane of the cutting tool 37 is the wafer angle controlling step.

If the wafer 1 is uniform in thickness, the wafer angle controlling step is achieved by merely setting the suction surface 22*a* of the chuck table 20 to be horizontal as above-mentioned. However, in the case where the thickness of the wafer 1 varies to the outside of an allowable range of evenness (for example, where a thickness unevenness of not less than 3 μm is present), the face-side surface 1*a* of the wafer 1 would not become parallel to the cutting or machining plane of the cutting tool 37 even if the suction surface 22*a* of the chuck table 20 is set to be horizontal. In this case, it suffices to grasp the condition of the thickness unevenness of the wafer 1 at the stage before covering with the resin film 5, and, based on the grasped condition, to properly incline the chuck table 20 so as to make horizontal the face-side surface 1*a* of the wafer 1 held by the chuck table 20, thereby controlling the above-mentioned facing angle.

Grasping the thickness unevenness condition of the wafer 1 can be achieved by measuring the thickness of the wafer 1 at a plurality of positions (for example, at three positions), with the notch 4 in the wafer 1 as a reference position. To control the facing angle by holding the wafer 1 on the chuck table 20, it suffices to incline the chuck table 20 so that the face-side surface 1*a* of the wafer 1 becomes horizontal, with the notch 4 as a reference.

Figure 7:
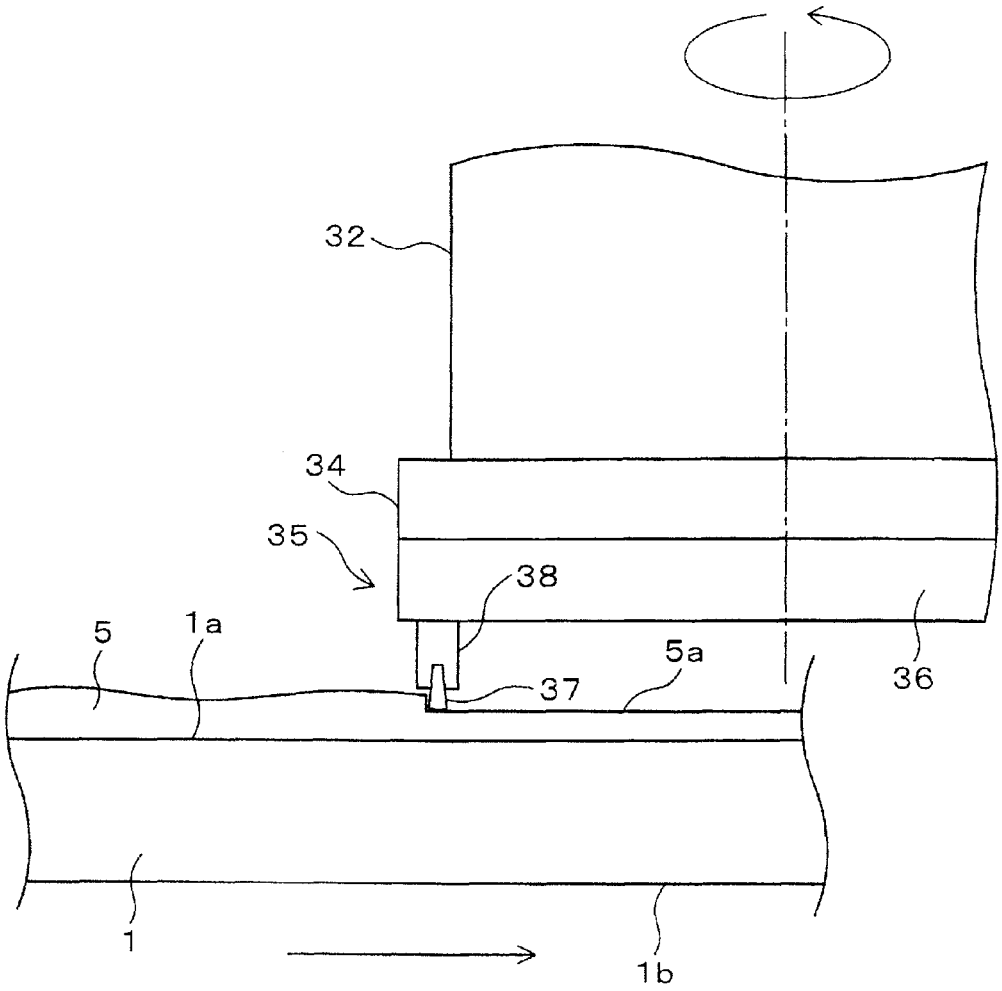
FIG. 7 is a side view showing the condition in which a resin film on the face-side surface of the wafer is being cut by the cutting apparatus shown in FIG. 3.

After the face-side surface 1*a* of the wafer 1 is thus set to be horizontal, i.e., set to be parallel to the cutting or machining plane of the cutting tool 37, the surface 5*a* of the resin film 5 is cut to be flat by the cutting tool 37 of the cutting unit 30 (resin film cutting step). For performing this step, the cutting unit 30 is lowered by the feeding mechanism 54 to such a height that the height of the tip of the cutting part of the cutting tool 37 is set to a height for cutting the resin film 5 by a predetermined amount (for example, about 1 to 10 μm), and, further, the cutting implement 35 is put into rotation. Then, the table base 25 is moved toward the depth side, thereby gradually moving the wafer 1 toward the machining position. Attended with the movement, as shown in FIG. 7, the surface 5*a* of the resin film 5 is gradually cut by the cutting tool 37 being in rotation. The cutting implement 35 is operated at a rotational speed of about 2000 rpm, and the moving speed of the table base 25, or the feed rate for grinding, is set to about 0.1 to 1 mm/sec.

At the time when the wafer 1 has been moved until covered with the frame 36, the whole area of the surface 5*a* of the resin film 5 has been cut to be flat. When the resin film 5 has been cut by a required amount at this stage, the resin film cutting step is finished. On the other hand, where the required cutting amount has not yet been attained, the table base 25 is reciprocated so that the cutting tool 37 is made to act on the surface 5*a* of the resin film 5 a plurality of times.

After the whole area of the surface 5*a* of the resin film 5 is cut by the required amount, the cutting unit 30 is raised to retract from the wafer 1, whereas the table base 25 is returned into the loading/unloading position. At the loading/unloading position, the vacuum operation of the chuck table 20 is stopped. Then, the wafer 1 is fed by a recovery arm 17 to a spinner type cleaning apparatus 18, where it is cleaned and dried. Thereafter, the wafer 1 is fed by the feeding robot 13 to, and contained into, a recovery cassette 19. Besides, the chuck table 20 from which the wafer 1 has been unloaded is cleared of cuttings and the like by air jetted from an air nozzle 27.

Figure 8:
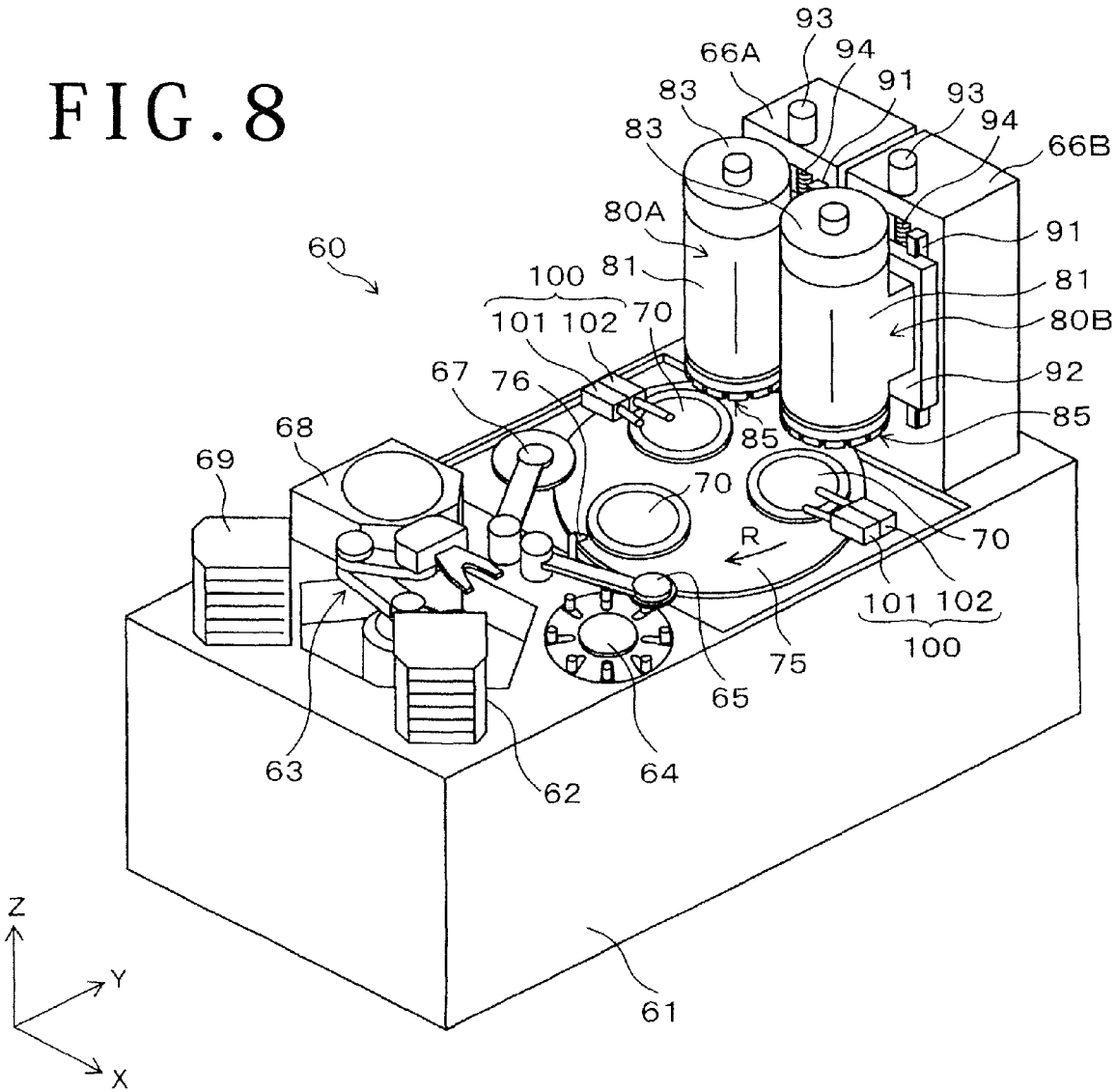
FIG. 8 is a general perspective view of a grinding apparatus used in the method according to the embodiment.

After the surface 5*a* of the resin film 5 is cut and the surface 5*a* is machined to be parallel to the face-side surface 1*a* of the wafer 1 in the above-mentioned manner, the back-side surface 1*b* of the wafer 1 is then ground to thin the wafer 1 to a desired thickness. For the back grinding of the wafer 1, a grinding apparatus 60 for performing infeed grinding shown in FIG. 8 is preferably used. According to the grinding apparatus 60, the wafer 1 is held by sucking the cut surface 5*a* of the resin film 5 onto a suction surface of a vacuum chuck type chuck table 70, and the back-side surface 1*b* of the wafer 1 is subjected sequentially to rough grinding and finish grinding by use of two grinding units (for rough grinding and for finish grinding) 80A and 80B.

Now, the configuration and operations of the grinding apparatus 60 will be described below. The grinding apparatus 60 has a rectangular parallelopiped base 61, and a plurality of the wafers 1 are stackedly contained in a supply cassette 62 detachably set at a predetermined position on the base 61, with the face-side surface 1*a* of each of the wafers 1 up. One of the wafers 1 is drawn out of the supply cassette 62 by a feeding robot 63, and the wafer 1 is mounted on a positioning table 64, with its back-side surface 1*b* up, where it is positioned to a predetermined position.

On the base 61, a turntable 75 driven to rotate in an R direction is provided. At outer peripheral parts of the turntable 75, a plurality of (in this case, three) circular disk-shaped chuck tables 70 are disposed at regular intervals along the circumferential direction. Each of the chuck tables 70 is rotatably supported, and is rotated in one direction or in both directions by a rotational driving mechanism (not shown).

Figure 9A:
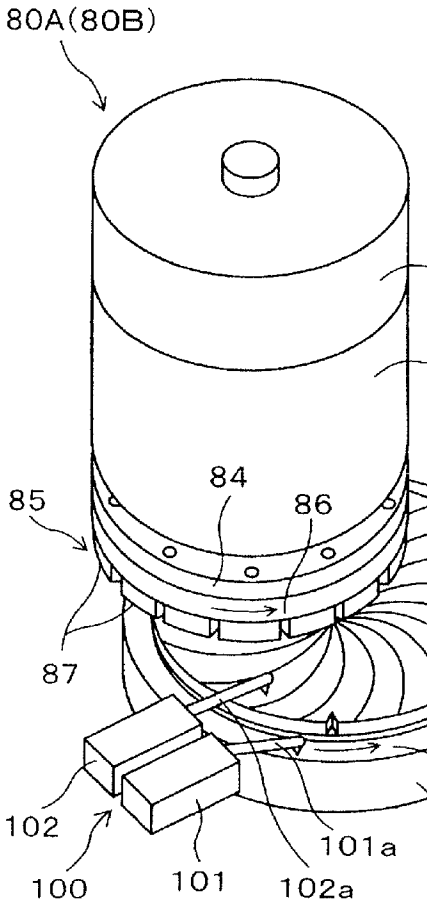
FIG. 9A is a perspective view showing the condition in which the back-side surface of the wafer is being ground by a grinding unit possessed by the grinding apparatus shown in FIG. 8.
Figure 9B:
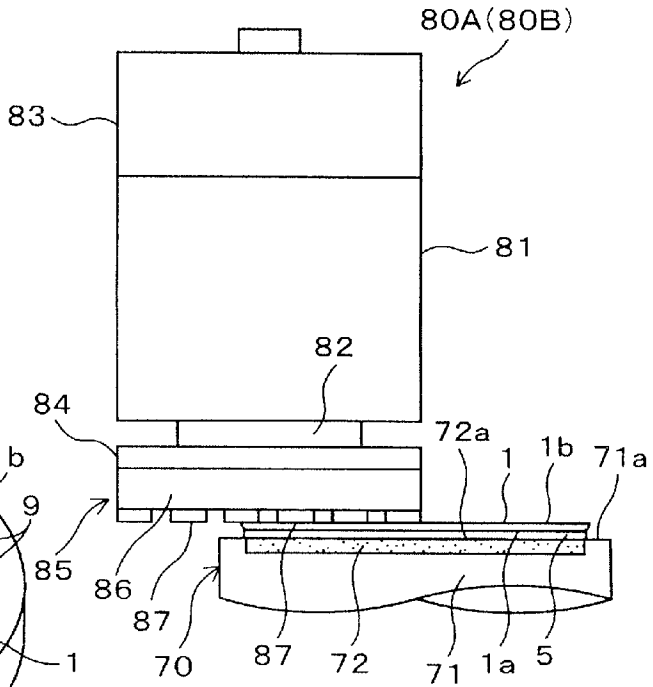
FIG. 9B is a side view of the same.

The wafer 1 positioned on the positioning table 64 is picked up from the positioning table 64 by a supply arm 65, and is mounted on one of the chuck tables 70 being in vacuum operation, with its face-side surface 1*a* up and in a concentric manner. As shown in FIG. 9B, the chuck table 70 has a structure in which a circular suction part 72 composed of a porous member is formed at a central upper part of a frame body 71. The wafer 1 is suction held in the condition where the surface 5*a* of the resin film 5 is put in contact with a suction surface 72*a* serving as a horizontal upper surface of the suction part 72 and where the back-side surface 1*b* is exposed. The suction surface 72*a* is formed to be flush with a surface 71*a* of the frame body 71.

With the turntable 75 rotated by a predetermined angle in the R direction, the wafer 1 held by the chuck table 70 is fed into a primary machining position under the grinding unit 80A for rough grinding, where rough grinding of the back-side surface 1*b* is conducted by the grinding unit 80A. Then, the turntable 75 is again rotated by a predetermined angle in the R direction, whereby the wafer 1 is fed into a secondary machining position under the grinding unit 80B for finish grinding, where finish grinding of the back-side surface 1*b* is performed by the grinding unit 80B.

At an end part on the depth side of the base 61, two columns 66A and 66B arranged side by side in an X direction are erectly provided, and the grinding units 80A and 80B are disposed at front surfaces of the columns 66A and 66B so that they can be lifted up and down in the Z direction (vertical direction). The lifting mechanisms here are the same as that in the case of the cutting unit 30 described above, and the grinding units 80A and 80B are slidably mounted to guides 91 provided at the front surfaces of the columns 66A and 66B and extending in the Z direction, through sliders 92, respectively. Besides, each of the grinding units 80A and 80B is lifted up and down in the Z direction through the slider 92, by a ball screw type feeding mechanism 94 driven by a servo motor 93.

The grinding units 80A and 80B are the same in basic configuration, and are distinguished from each other in that one of them is equipped with a grindstone for rough grinding whereas the other is equipped with a grindstone for finish grinding. As shown in FIGS. 9A and 9B, each of the grinding units 80A and 80B has a cylindrical spindle housing 81 of which the axial direction lies in the Z direction, and a spindle shaft 82 driven to rotate by a spindle motor 83 is supported inside the spindle housing 81. A grinding wheel 85 is attached to the lower end of the spindle shaft 82 through a flange 84.

The grinding wheel 85 has a plurality of grindstones 87 arrayed on and firmly attached to the lower surface of an annular frame 86. A grinding or machining plane formed by the lower surfaces of the grindstones 87 is set to be horizontal, i.e., to be orthogonal to the axial direction of the spindle shaft 82. Therefore, the grinding or machining plane is parallel to the suction surface 72*a* of the chuck table 70. As the grindstone 87, for example, a grind stone obtained by mixing diamond abrasive grains into a vitreous bonding material, molding the mixture, and sintering the molded product is used.

As the grindstones 87 attached to the grinding unit 80A for rough grinding, for example, those containing comparatively coarse abrasive grains of about #320 to #400 are used. On the other hand, as the grindstones 87 attached to the grinding unit 80B for finish grinding, for example, those containing comparatively fine abrasive grains of about #2000 to #8000 are used. Each of the grinding units 80A and 80B is provided with a grinding water supply mechanism (not shown) for supplying grinding water for cooling the surface under grinding, for lubrication or for discharging the debris generated upon grinding.

The grinding wheel 85 is rotated as one body with the spindle shaft 82, and the outer diameter of grinding by the grindstones 87 in rotation is set to be greater than the diameter of the wafer 1. In addition, a machining position of the wafer 1 which is determined by rotating the turntable 75 by a predetermined angle is so set that the cutting edges at the lower surfaces of the grindstones 87 pass through the center of rotation of the wafer 1 and that the whole area of the back-side surface 1*b* of the wafer 1 put into revolution about its center by rotating the chuck table 70 can be ground.

The back-side surface 1*b* of the wafer 1 is ground by the grinding units 80A and 80B at the machining positions for rough grinding and finish grinding, respectively (back grinding step). The back grinding is performed by a process in which the chuck table 70 is rotated to put the wafer 1 into revolution about its center, the grinding unit 80A (80B) is gradually lowered by the feeding unit 94, and, in this condition, the grindstones 87 of the grinding wheel 85 in rotation are pressed against the exposed back-side surface 1*b* of the wafer 1. While the wafer 1 is thinned to a desired thickness through the rough grinding and the finish grinding, the measurement of thickness is performed by thickness measuring gauges 100 provided in the vicinity of the machining positions.

The thickness measuring gauge 100 includes a combination of a reference-side height gauge 101 having a probe 101*a* brought into contact with the surface 71*a* of the frame body 71 of the chuck table 70, with a movable-side height gauge 102 having a probe 102*a* brought into contact with the work surface (in this case, the back-side surface 1*b* of the wafer 1). The thickness of the wafer 1 under back grinding is minutely measured by comparing the height values measured by both the height gauges 101 and 102. The back grinding of the wafer 1 is carried out while measuring the thickness of the wafer 1 by the thickness measuring gauge 100, and the feed amount of the grinding wheel 85 fed by the feeding mechanism 94 is controlled based on the measured value of wafer thickness. Incidentally, the rough grinding is conducted until the wafer is thinned to a thickness value which is greater than the desired thickness upon finish grinding by, for example, 20 to 40 μm, and the residual part of thinning is carried out by the finish grinding. Incidentally, as shown in FIG. 9A, grinding streaks 9 in a pattern of a multiplicity of arcs drawn radially are left in the back-side surface 1*b* of the wafer 1 thus ground. The grinding streaks 9 are removed, as required, by such means as etching after the back grinding steps are finished.

After the wafer 1 is thinned to the desired thickness through the rough grinding and the finish grinding, recovery of the wafer 1 is carried out as follows. First, the finish grinding unit 80B is raised to retract from the wafer 1, whereas the turntable 75 is rotated by a predetermined angle in the R direction, whereby the wafer 1 is returned to the loading/unloading position at which the wafer 1 has been put from the supply arm 65 onto the chuck table 70. At the loading/unloading position, the vacuum operation of the chuck table 70 is stopped. Then, the wafer 1 is fed by a recovery arm 67 to a spinner type cleaning apparatus 68, where it is cleaned and dried. Thereafter, the wafer 1 is fed by the feeding robot 63 to, and contained into, a recovery cassette 69. In addition, the chuck table 70 from which the wafer 1 has been unloaded is cleared of debris generated upon grinding and the like by washing water discharged from a nozzle 76.

In the above-described manner, the back-side surface 1*b* of the wafer 1 is ground, and the wafer 1 is thinned to the desired thickness. The wafer 1 is finally cut and split along the planned dividing lines 2 into a plurality of individual semiconductor chips 3; in this case, the resin film 5 formed on the face-side surface 1*a* of the wafer 1 is removed, as required, before division into the individual chips, by peeling it off with a highly tacky pressure sensitive adhesive tape or by dissolving it with a solvent or by the like means. In some cases, the resin film 5 is not removed but is left as it is when division into the individual semiconductor chips 3 is carried out. In this case, the resin film 5 is so formed that electrodes of the semiconductor chips 3 formed on the side of the face-side surface 1*a* of the wafer 1 are not covered with the resin film 5 and that wiring to the electrodes can be performed at the time of mounting of the semiconductor chip 3.

Meanwhile, in this embodiment, in grinding the back-side surface 1*b* of the wafer 1, the face-side surface 1*a* is covered with the resin film 5 for protecting the face-side surface 1*a*. Not only the resin film 5 is merely formed on the face-side surface 1*a* but also the surface 5*a* of the resin film 5 is cut. In this case, the wafer angle controlling step is conducted in which the face-side surface 1*a* of the wafer 1 held onto the suction surface 22*a* of the chuck table 20 in the cutting apparatus 10 is controlled to be parallel to the cutting or machining plane of the cutting tool 37, and, in the subsequent resin film cutting step, the surface 5*a* of the resin film 5 is cut. By this process, the surface 5*a* is formed to be a flat surface parallel to the face-side surface 1*a* of the wafer 1.

In the case where unevenness is present in the thickness of the resin film 5 formed on the face-side surface 1*a* of the wafer 1, the thickness unevenness is eliminated by cutting the surface 5*a* of the resin film 5, or, if present, the thickness unevenness is suppressed to an extremely minute level of about 1 μm, for example. Then, when the wafer 1 is held while putting the thus cut surface 5*a* of the resin film 5 in contact with the suction surface 72*a* of the chuck table 70 in the grinding apparatus 60, the face-side surface 1*a* of the wafer 1 is horizontal, in other words, it is parallel to the grinding or machining plane of the grindstones 87 of the grinding unit 80A (80B). Therefore, when the back-side surface 1*b* of the wafer 1 is ground starting from this condition, the back-side surface 1*b* is ground to be a flat surface parallel to the face-side surface 1*a*. That is, the thickness of the wafer 1 as a single body having undergone the back grinding is uniform in thickness. In the back grinding step, the resin film 5 makes contact with the chuck table 70, whereby the semiconductor chips 3 on the side of the face-side surface 1*a* are protected.

According to this embodiment, the unevenness in the thickness of the resin film 5 is suppressed, whereby the thickness unevenness of the wafer 1 after back grinding is also suppressed accordingly. As a result, particularly where the desired thickness of the wafer 1 is as extremely small as about 30 to 50 μm, also, the influence of the thickness unevenness on the overall thickness of the wafer 1 can be obviated. Thus, the method according to this embodiment is highly promising as a method of back grinding for a wafer which is as extremely thin as this level.

In the prior art, the surface protective member used at the time of back grinding for a wafer has been a protective tape or the like which has unevenness in thickness. In this embodiment, on the other hand, the face-side surface 1*a* of the wafer 1 is covered with the resin film 5 used instead of a protective tape, and the surface 5*a* of the resin film 5 is cut to be parallel to the face-side surface 1*a* of the wafer 1 and to be used as a reference plane at the time of back grinding. Then, the surface 5*a* of the resin film 5 is brought into contact with the suction surface 72*a* of the chuck table 70, which ensures that the wafer 1 subjected to back grinding will be uniform in thickness. Since the resin film 5 covering the face-side surface 1*a* of the wafer 1 is so cut that its surface 5*a* is made parallel to the face-side surface 1*a* of the wafer 1, it is unnecessary to especially control the thickness of the resin film 5 rigorously at the time of applying the resin film 5 to the face-side surface 1*a*. Therefore, the kind of material of the resin film 5, the method of application, and the like factors can be selected comparatively freely, from the viewpoints of the rugged (projection-and-recess) condition of the face-side surface 1*a*, ease of application, cost, etc.

Figure 10A:
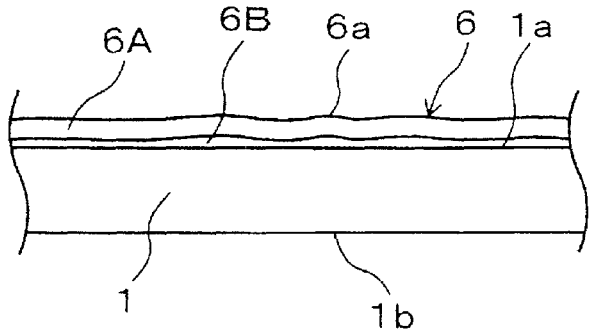
FIGS. 10A to 10C are side views showing the gist of the method in the case where a pressure sensitive adhesive tape is used as the resin film.

Incidentally, while the resin film 5 formed by application of a liquid resist has been used as the surface protective member in the above-described embodiment, a pressure sensitive adhesive tape 6 shown in FIG. 10A may be used in place of the resin film 5. Examples of the pressure sensitive adhesive tape 6 include one having a structure in which a pressure sensitive adhesive material 6B is applied in a thickness of about 10 μm to one side of a base sheet 6A made of a resin such as polyolefin and having a thickness of about 100 to 200 μm.

Figure 10B:
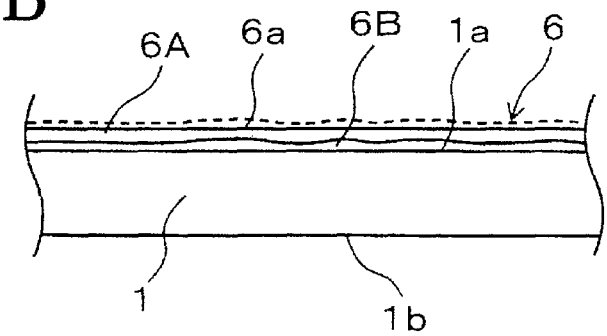
Figure 10C:
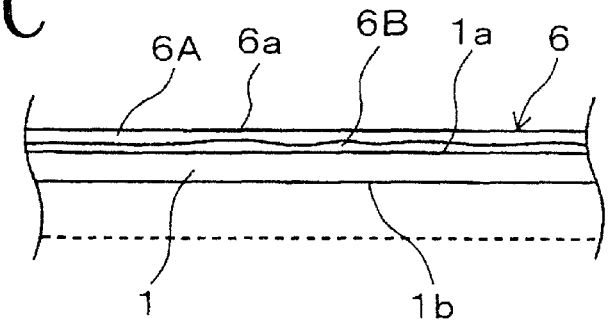

Such a pressure sensitive adhesive tape 6 is adhered to the face-side surface 1*a* of the wafer 1 through the pressure sensitive adhesive material 6B. Then, as shown in FIG. 10B, the surface 6*a* of the base sheet 6A is cut to be parallel to the face-side surface 1*a* of the wafer 1. Subsequently, as shown in FIG. 10C, the back-side surface 1*b* of the wafer 1 is ground to thin the wafer 1 to a desired thickness.

In the mode in which the pressure sensitive adhesive tape 6 is adhered to the face-side surface 1*a* of the wafer 1, the operation of covering the face-side surface 1*a* with the resin film is comparatively easy to carry out. In addition, removal of the resin film can also be easily carried out by peeling off the pressure sensitive adhesive tape 6 itself. Thus, this mode is advantageous on a workability basis.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A method of grinding a back-side surface of a wafer having a face-side surface provided with devices, said method comprising:

a resin film covering step of covering said face-side surface of said wafer with a resin film;

a wafer holding step of holding said wafer, with said face-side surface exposed, by a holding means of a cutting apparatus of which the facing angle relative to a machining plane of a cutting member held by a rotating body can be controlled to be substantially parallel;

a wafer angle controlling step of regulating the facing angle of said holding means relative to said cutting member so as to control said face-side surface of said wafer held by said holding means to be substantially parallel to said machining plane of said cutting member;

a resin film cutting step of cutting a surface of said resin film to be flat by said cutting member being rotated; and a back-side grinding step of holding said wafer by a holding means of a grinding apparatus with the cut surface of said resin film being directed downward and grinding said exposed back-side surface of said wafer.

2. The method of grinding a back-side surface of a wafer as set forth in claim 1, wherein said resin film with which said face-side surface of said wafer is covered in said resin film covering step is formed by applying a resin to said face-side surface of said wafer by a spin coating process.

3. The method of grinding a back-side surface of a wafer as set forth in claim 1, wherein said resin film with which said face-side surface of said wafer is covered in said resin film covering step is provided by adhering a pressure sensitive adhesive tape to said face-side surface of said wafer.

* * * * *